US006383029B1

(12) United States Patent
Bolouri-Saransar

(10) Patent No.: US 6,383,029 B1
(45) Date of Patent: May 7, 2002

(54) METHOD OF REDUCING SIGNAL COUPLING IN A CONNECTOR, A CONNECTOR AND A CABLE INCLUDING SUCH A CONNECTOR

(75) Inventor: Masud Bolouri-Saransar, Nærum (DK)

(73) Assignee: LK A/S, Ballerup (DK)

( * ) Notice: Subject to any disclaimer, the term of this patent is extended or adjusted under 35 U.S.C. 154(b) by 0 days.

(21) Appl. No.: 09/446,238

(22) PCT Filed: Jul. 10, 1998

(86) PCT No.: PCT/DK98/00322

§ 371 Date: Jan. 24, 2000

§ 102(e) Date: Jan. 24, 2000

(87) PCT Pub. No.: WO99/03172

PCT Pub. Date: Jan. 21, 1999

(30) Foreign Application Priority Data

Jul. 10, 1997 (DK) ..... 0839/97

(51) Int. Cl.[7] ..... H01R 24/00
(52) U.S. Cl. ..... 439/676; 439/941
(58) Field of Search ..... 439/676, 941

(56) References Cited

U.S. PATENT DOCUMENTS 4,149,026 A 4/1979 Fritz et al. ..... 174/32
4,287,385 A 9/1981 Dombrowsky ..... 174/36
5,094,623 A 3/1992 Scharf et al. ..... 439/101
5,547,405 A * 8/1996 Pinney et al. ..... 439/676
5,577,931 A 11/1996 Leshem ..... 439/497
5,599,209 A * 2/1997 Belopolsky ..... 439/676
5,639,266 A 6/1997 Patel ..... 439/676

* cited by examiner

*Primary Examiner*—Tulsidas Patel
(74) *Attorney, Agent, or Firm*—Ladas & Parry

(57) ABSTRACT

A method of reducing signal cross talk during coupling in a connector for the transfer of balanced electrical high frequency signals provides a connector with contact springs (5) and terminals (4) as well as first and second non-co-axial pairs of first and second conductors ($A_+$, $A_-$), ($D_+$, $D_-$) arranged in an insulation member (9) to connect the contact springs (5) and the terminals (4) for respectively transferring the balanced signals. The conductors ($A_+$, $A_-$), ($D_+$, $D_-$) of each of the pairs are respectively in two spaced layers. An effective permittivity $\in_{r-1}$ between the first conductor ($A_+$) of the first pair of conductors ($A_+$, $A_-$) and the first conductor ($D_+$) of the second pair of conductors ($D_+$, $D_-$) is different from an effective permittivity $\in_{r-2}$ between the second conductor ($A_-$) of the first pair of conductors ($A_+$, $A_-$) and first conductor ($D_+$) of the second pair of conductors ($D_+$, $D_-$)

14 Claims, 4 Drawing Sheets

METHOD OF REDUCING SIGNAL COUPLING IN A CONNECTOR, A CONNECTOR AND A CABLE INCLUDING SUCH A CONNECTOR

BACKGROUND OF THE INVENTION

The invention relates to a method of reducing cross talk during signal coupling (hereinafter referred to in shorter convenience as signal coupling) in a connector for the transfer of balanced electrical high frequency signals, said connector comprising contact springs and terminals as well as a plurality of pairs of conductors arranged in an insulation member to connect the contact springs and the terminals, each said pair of conductors being capable of transferring one of the balanced signals.

The invention moreover relates to a connector for the transfer of balanced electrical high frequency signals, said connector comprising contact springs and terminals as well as a plurality of pairs of conductors arranged in an insulation member to connect the contact springs and the terminals, each said pair of conductors being capable of transferring one of the balanced signals.

The invention also relates to a connecting element comprising a plurality of pairs of conductors arranged in an insulation member for the transfer of balanced electrical high frequency signals, each said pair of conductors being capable of transferring one of the balanced signals.

The invention finally relates to a cable which is terminated by a connector at one or both ends.

The transfer of data at very high transmission rates in cables connected by plugs or connectors which may contain many conductors, involves the known problem that so-called crosstalk may occur between the various conductors, which means that signals carried through a conductor will give an unintentional signal contribution through another conductor because of the inevitable capacitance which exists between the conductors. This is aggravated particularly by the circumstance that the distances between the conductors are typically very small so that the size of the capacitances becomes significant.

The patent literature describes many ways of minimizing crosstalk in plugs which are used for high frequency data transfers.

Particularly plugs connecting cables involve a great risk of undesired crosstalk.

A plug for high transmission data usually consists of terminals at one end which are intended to be connected to a cable, a printed circuit board or the like. A connecting element extends from the terminals, consisting of a number of conductors which are arranged in e.g. a dielectric. A plurality of contact springs corresponding to the plurality of conductors is arranged at the other end of the conductors. The contact springs are intended to make contact with another plug. Usually, the contact springs are very closely spaced, which means that the conductors, which are also called connecting conductors below, are very close in the area in which the connection between the contact springs and the connecting conductors is established.

To prevent the previously mentioned crosstalk, the most simple solution is to make the distance between the connecting conductors in the area where the terminals are present, as great as possible. This solution, however, does not compensate the crosstalk, which occurs in the area where the connecting conductors are connected to the contact springs.

Another way of minimizing crosstalk, cf. e.g. U.S. Pat. No. 5,186,647, comprises crossing the pairs of conductors in the area where the contact springs are connected to the connecting conductors. This way of reducing the crosstalk involves a balanced capacitive coupling from each conductor to a conductor of another pair. Signal coupling from the individual conductor will have the same size and polarity to both conductors from another pair, and since only differential signals are of importance, this influence will not be regarded as crosstalk. A possible influence from the pair of conductors to the individual conductor in another air will neutralize itself, since crosstalk contributions from each pole in the pair of conductors gives a capacitive coupling of almost the same size with identical and opposite polarity, which means that the crosstalk contributions will therefore neutralize themselves. The crosstalk occurring between the conductors in the connector is compensated in this manner.

Finally, the art includes a method in which compensation capacitances are added between the connecting conductors which are mounted on e.g. a printed circuit board.

SUMMARY OF THE INVENTION

Accordingly, an object of the invention is to provide a method of the type stated in the introductory portion of claim 1 which ensures a minimum of crosstalk in a connector which is used for the transfer of data.

The object of the invention is achieved in that the pairs of conductors in the insulation member are positioned in two mutually spaced layers in such a manner that each of the two conductors belonging to a pair is arranged in a layer of its own, and that said insulation member is made of at least two dielectrics with different permittivity.

Hereby, a possible influence from the individual conductor will be of the same size and have the same polarity for both conductors from another pair, and since only differential signals are of importance, this influence will not be regarded as crosstalk. A possible influence from the pair on the individual conductor will neutralize itself, as crosstalk contributions from each pole give a capacitive coupling of almost the same size with identical and opposite polarities and will therefore neutralize themselves.

Crosstalk occurring in the contact spring part will be compensated by adding an unbalanced capacitive contribution between the conductors of a pair and a conductor or a pole from another pair in the connecting conductors near the contact springs. All things considered, the invention thus provides a method which partly neutralizes the influence from a pole in a pair of conductors on both poles in another pair of conductors, and partly neutralizes a contribution from two poles in a pair to a pole of another pair, as well as compensates crosstalk which occurs in plugs and the contact conductor part.

It is expedient that the one dielectric used is atmospheric air.

The one dielectric is provided as a notch in the insulation member. This may be done relatively simply.

If it is desired to have a connector which must not be made physically weaker, it may be an advantage, that the notch is filled with a dielectric with another permittivity which has a lower value than the notched material.

As mentioned, the invention also relates to a connector. This connector is of the type stated in the introductory portion of claim 5 and is characterized in that the pairs of conductors in the insulation member are placed in two mutually spaced layers in such a manner that each of the two conductors associated with a pair is arranged in a layer of its own, and that said insulation member comprises at least two dielectrics with different permittivity.

This connector, of course, has the advantages which have already been explained in connection with claim 1.

As mentioned, the invention also relates to a connecting element. This connecting element is characterized in that the pairs of conductors in the insulation member are placed in two mutually spaced layers in such a manner that each of the two conductors belonging to a pair is arranged in a layer of its own, and that said insulation member comprises at least two dielectrics with different permittivity.

Finally, as mentioned, the invention relates to a cable, i.e. a cable which is terminated by a connector according to the invention at one or both ends.

BRIEF DESCRIPTION OF THE DRAWING

The invention will now be explained more fully below with reference to an example shown in the drawing, in which.

DESCRIPTION OF EMBODIMENTS

Figure 1:
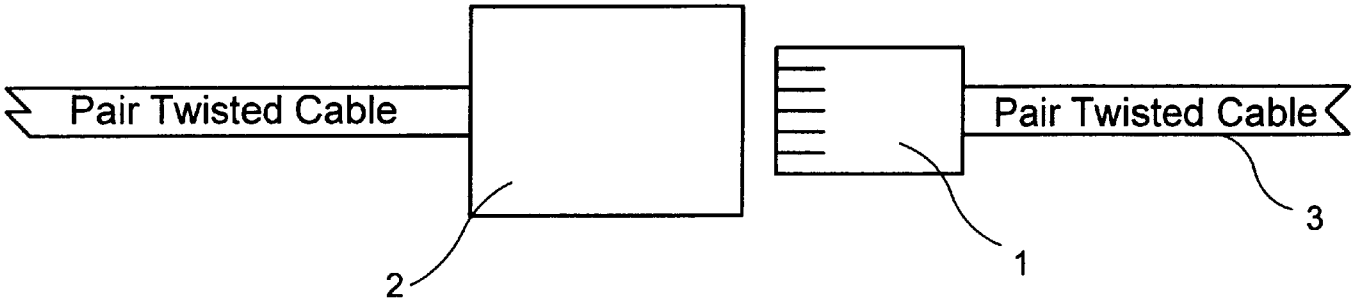
FIG. 1 shows an ordinary plug connection in which two connectors are connected to their respective cables.

As will be seen, FIG. 1 shows two connectors which are designated 1 and 2, respectively. These connectors 1, 2 are connected to a cable 3 at their ends, and contact springs are provided at the other end for connection of the two connectors 1, 2. It is noted that connectors may of course be configured to be connected in other known ways, but that the term contact springs will be used below for such connecting parts.

Figure 2:
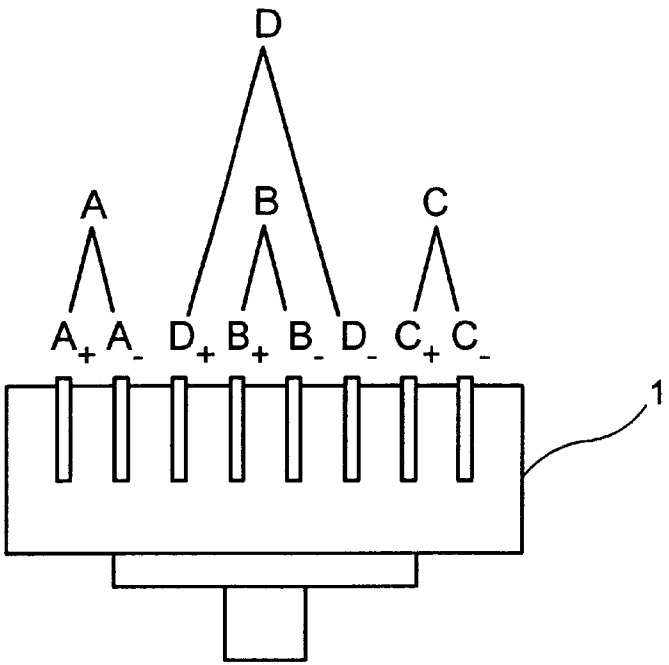
FIG. 2 shows a typical structure of conductors in pairs in a connector, e.g. as shown in FIG. 1.

As will moreover be seen, FIG. 2 shows a connector 1 having eight conductors which consist of four pairs of conductors. These pairs of conductors are used for transferring balanced differential signals. To facilitate the later understanding of the invention, the two poles of the pair of conductors A will be called $A_+$, and $A_-$. Similarly, the other pairs of conductors are called $B_+$, $B_-$, $C_+$, $C_-$ and $D_+$, $D_-$. It should also be noted that the pair of conductors D is spaced more from each other than the other pairs of conductors, as the pair of conductors B has poles which are positioned within the two poles of the pair of conductors D.

Figure 3:
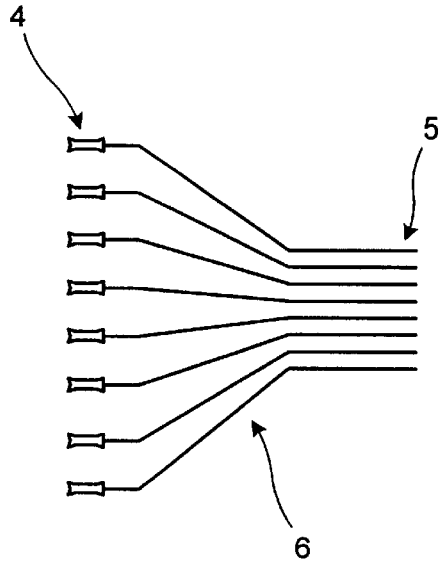
FIG. 3 shows a first known way in which the conductors in a connector may be placed.

FIG. 3 shows a first example of how the conductors in a connector may be placed. This figure schematically shows a connector having contact springs 5 at one end and terminals 4 at the other end, connected to conductors 6. These conductors 6 will typically be arranged in an insulation member having a given dielectric constant. It is noted that terminals are used below as a term for the means that establish the connection between the connector and a cable, although other known means may be used for establishing this connection. Clearly, the capacitive coupling is greatest in the area at the contact spring part, since the physical distances between the individual pairs of conductors are smallest here. The resulting crosstalk, however, will be attenuated somewhat because the connecting conductors have somewhat greater physical distances in the vicinity of the terminals.

Figure 4:
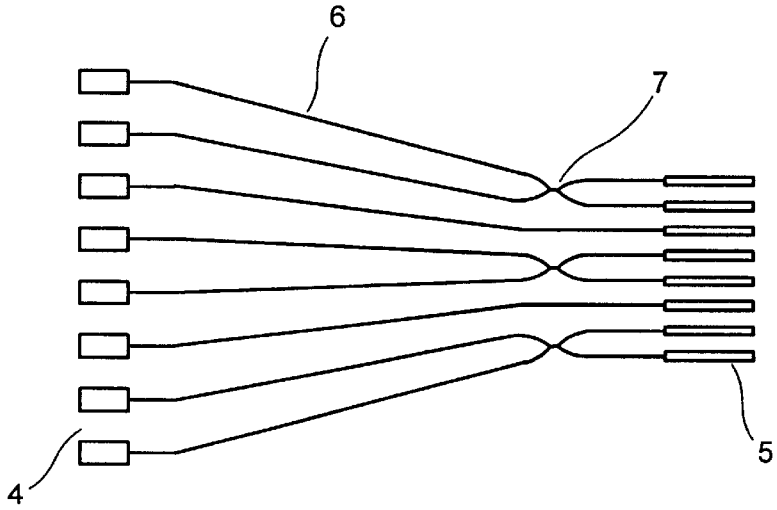
FIG. 4 shows a known way of compensating crosstalk.

FIG. 4 shows a variant of the connector shown in FIG. 3, as the various pairs of conductors, except the pair of conductors D, are crossed here, cf. also the notation in connection with FIG. 2. A certain compensation of crosstalk may be obtained in this manner, as the cross is positioned suitably such that the capacitive coupling between each of the two conductors which are crossed and the adjacent conductor is of approximately the same size.

Figure 5:
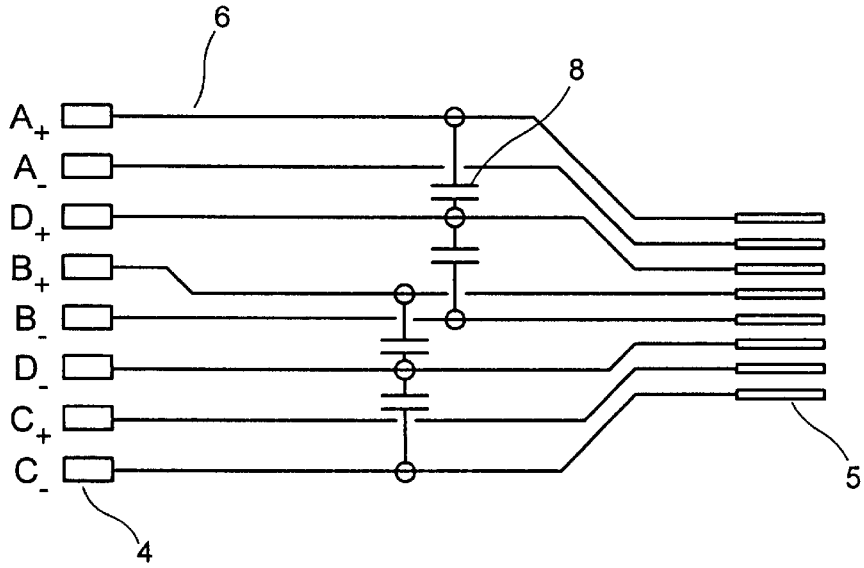
FIG. 5 shows another known way of compensating crosstalk.

Finally, FIG. 5 shows a way in which crosstalk is compensated by embedding the connecting conductors 6 in a printed circuit board (not shown) and then placing capacitances 8 between the pairs of conductors. Using the notation from FIG. 2 again, it will be seen that capacitances 8 have been added between $A_+$, and $D_+$, between $D_+$ and $B_-$, between $B_+$ and $D_-$, and between $D_-$ and $C_-$. These capacitances 8 are added to obtain compensation of differences in the capacitive couplings between the individual conductors 6. For example, the capacitance 8 between $A_+$ and $D_+$ will be selected suitably so that the total capacitive coupling between $A_+$, and $D_+$ will correspond to the capacitive coupling between $A_-$ and $D_+$. Addition of these capacitances 8 can thus provide a certain compensation of crosstalk between the conductors 6.

Figure 6A:
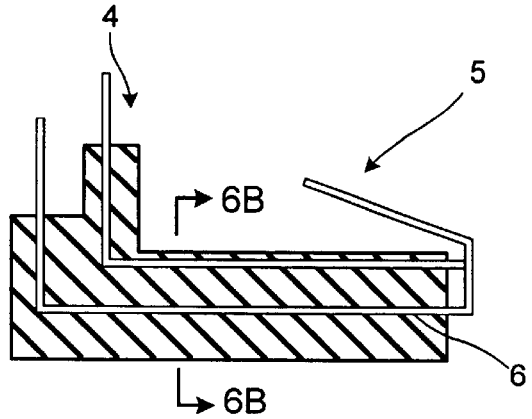
FIGS. 6*a*, 6*b* and 6*c* show how to neutralize crosstalk which originates from a pole in a first pair of conductors to both poles in a second pair of conductors according to the invention.
Figure 6B:
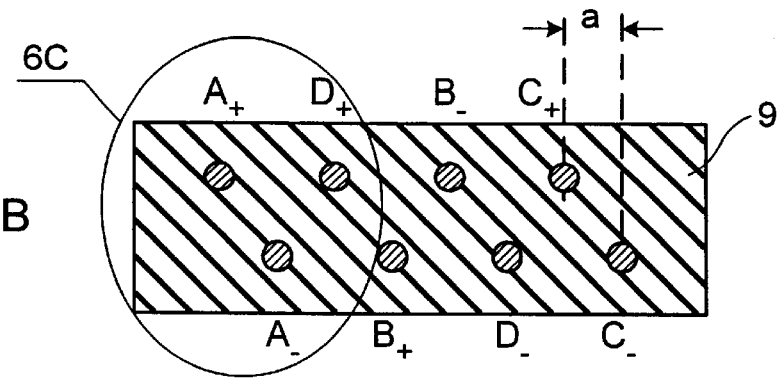
Figure 6C:
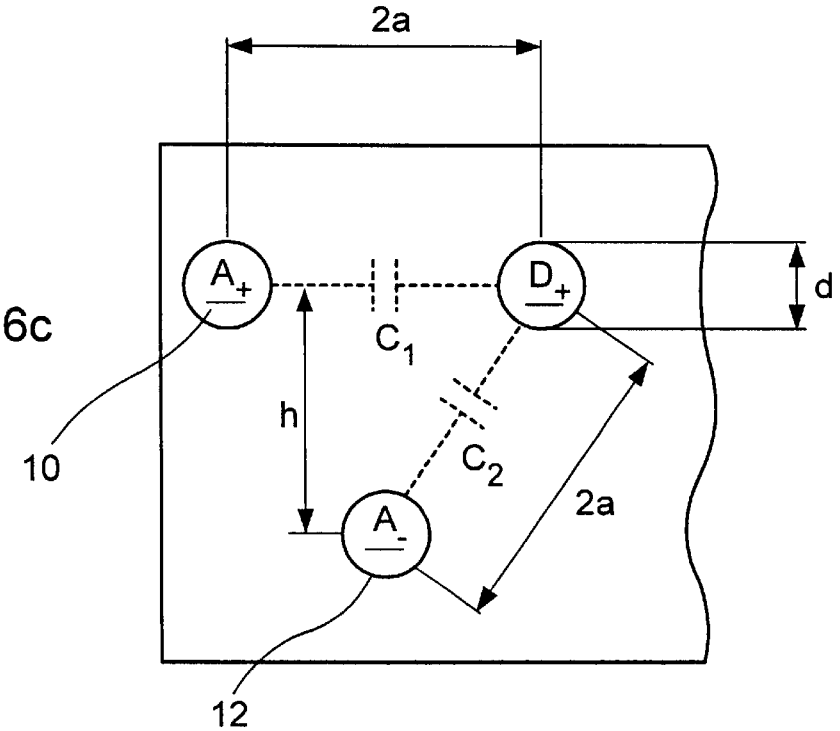

FIG. 6 shows a connector in three degrees of detail, where the upper one in FIG. 6 schematically shows part of the connector itself, the central one shows how the connecting conductors 6 are mounted in an insulation member 9, and the lower part of FIG. 6 shows a detailed section of the conductor arrangement. As will be seen in FIG. 6, the conductors are placed in two rows or layers. These layers may e.g. form parallel planes with parallel conductors. The conductors in the individual layers in the connector may e.g. be arranged such that these have the same or approximately the same mutual spacing, as shown in the figure, but may of course also have different mutual spacings, if this should be desirable. The two layers may be staggered with respect to each other, so that the staggering is of a suitable size. In the embodiment shown in the figure, the staggering is selected so as to achieve a suitable symmetrical conductor arrangement in the connector and thereby the same coupling between various conductors in the connector, which will appear from the following.

As will appear from the figure, the conductors of each pair of conductors are arranged in their respective layers. As an example, it is shown that the conductors in the pair of conductors $A_+$, $A_-$ are placed such that the conductor $A_+$ is placed in one layer, while the conductor $A_-$ is placed in the other layer. It will also be seen that, in the example shown, the pole $D_+$ in the pair of conductors D is placed in the same layer as the pole $A_+$. The conductors $A_+$, $A_-$ and $D_+$ are used below for describing the conditions in the compensation of crosstalk in a connector, but it should be stressed that other conductors might be used of course. It should also be noted that the conductors might of course be placed in other ways in the connector and yet be distributed such that the two conductors in each pair of conductors are placed in their respective layers. In the embodiment shown, as will additionally appear from FIG. 6, the centre distance between all the poles in the individual layers equals 2*a*, while the distance between the two layers or rows of conductors is designated h. A capacitive coupling $C_1$ is schematically shown between $A_+$ and $D_+$, while a coupling capacitor $C_2$ is shown between the pole $A_-$ and the pole $D_+$.

It can be shown that the coupling capacitors C (i.e. $C_1$ or $C_2$) between two conductors of circular cross-sections may be calculated by means of the equation:

$$C = \frac{L \cdot \pi \cdot \varepsilon_r \cdot \varepsilon_o}{\ln \frac{D + \sqrt{D - d}}{d}} = \varepsilon_r \cdot F(L),$$

where

D is the centre distance (2*a*) between the conductors, d is the conductor diameter, L is the length of the conductor, $\in_r$ is the relative dielectric constant (permittivity) , and $\in_o$ is the dielectric constant in vacuum.

The distance between the two layers may be selected so as to achieve a suitably small capacitive coupling between the conductors in the two layers by selecting a suitably great distance between the two layers. Increasing the capacitive coupling results in a reduction of the crosstalk between the layers. For example, when the distance h between the two layers is selected such that h equals $\sqrt{3}\cdot a$, the conductors will be positioned entirely symmetrically, which means that $C_1$ equals $C_2$. It is hereby ensured that the influence from a pole, e.g. $D_+$, on two poles, e.g. $A_+$ and $A_-$, in another pair of conductors is the same on both poles in the pair of conductors. Conversely, it thus applies that the influence from the two poles in a pair of conductors on a pole in another pair of conductors is neutralized, as the influence of the two poles is of the same size, but oppositely directed. Compensation of the crosstalk between the conductors in the connector is achieved hereby.

It is noted that it may be desirable to place the layers at a mutual distance which is greater than $\sqrt{3}\cdot a$ in order to achieve full or partial compensation of the crosstalk which will inevitably occur in other parts of the connector, e.g. at the contact springs, because of capacitive couplings between the conductors in these parts. As the connector typically has to satisfy some specific requirements with respect to physical dimensions, it is not always possible to place the layers at a suitably great mutual distance. It is described in connection with FIG. 7 how this problem is solved.

Figure 7A:
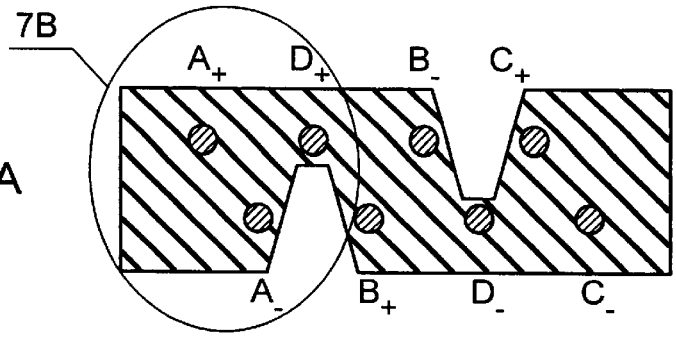
FIGS. 7*a* and 7*b* show how the influence from two poles in a pair of conductors on a pole in another pair of conductors may be compensated according to the invention.
Figure 7B:
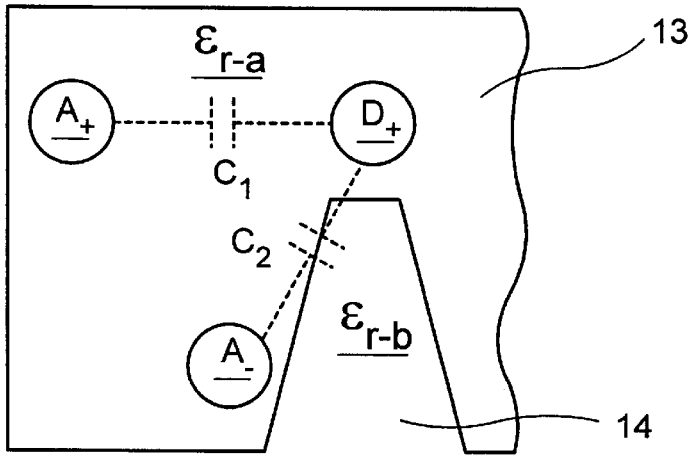

As mentioned, it is desirable to compensate crosstalk, which occurs because of capacitive couplings in all parts of the connector. It is schematically shown in FIG. 7 how compensation of crosstalk, which might e.g. have occurred in connection with the contact springs, takes place in the connecting wires. As will be seen, schematically shown is again part of a connector which is shown on an enlarged scale at the reference numeral 13. A notch has been made between the poles $A_-$ and $D_+$ in the connector, which comprises an insulation member with a first dielectric with the permittivity $\in_{r-2}$. The notch is filled by a second dielectric 14, as illustrated in the figure. This material is designated 14 and has another permittivity which is designated $\in_{r-b}$. It is noted that this second dielectric may e.g. be atmospheric air or a solid material having a permittivity which is lower than $\in_{r-a}$. The second material in the notch shown will give rise to another capacitive coupling between $A_-$ and $D_+$ compared with the situation shown in FIG. 6 for one thing, and for another give rise to another capacitive coupling between $A_-$ and $B_+$, cf. the notation previously used. In the case where $\in_{r-b}$ is selected smaller than $\in_{-a}$, these capacitive couplings will thus be reduced compared with the situation shown in FIG. 6.

In this case, the capacitances, cf. the equation stated above, may be described as $$C_1 = \in_{r-1} \cdot F(L),$$

and $$C_2 = \in_{r-2} \cdot F(L)$$

where $\in_{r-1}$ and $\in_{r-2}$ designate the effective permittivity between $A_+$ and $D_+$ and $A_-$ and $D_+$, respectively.

Where just a compensation of the crosstalk in the connecting conductors 6 in the insulation member 9 is desired, then $\in_{r-1}$ must equal $\in_{r-2}$. When, in the situation shown, it is additionally desired to compensate crosstalk between the conductors $A_-$ and $D_+$, which may e.g. be caused by the capacitive coupling between $A_-$ and $D_+$ because of their close physical position at the contact springs, a value of $\in_{r-b}$ smaller than $\in_{r-a}$ is selected, however. This will appear more clearly from the following.

If e.g. total compensation of crosstalk between $D_+$ and the pair of conductors $A_+$ and $A_-$ is desired, then it is necessary to perform compensation of the coupling between $A_-$ and $D_+$ and of the coupling between $A_+$ and $D_+$, which occur e.g. because of capacitive coupling at the contact springs and at the terminals.

The contribution from the coupling between $A_+$ and $D_+$ is disregarded below, as the coupling between $A_-$ and $D_+$ will be dominating because of the mutual position of the conductors, as will appear from FIG. 2. This provides compensation when $$C_2 + C_{A-,D+} = C_1 \Rightarrow \varepsilon_{r-1} - \varepsilon_{r-2} = \frac{C_{A-,D+}}{F(L)}$$

which e.g. for a given L, may be realized by suitable selection of $\in_{r-1}$ and $\in_{r-2}$, which reflects the selection of dielectrics and thereby selection of $\in_{r-a}$ and $\in_{-b}$.

For reasons of symmetry, this compensation by using the second dielectric 14 from said compensation of said crosstalk will also result in an advantageous reduction of crosstalk between the poles $A_+$, $B_+$ and $B_-$, $C_+$. It is noted that a suitably low value of the permittivity $\in_{r-b}$ of the second dielectric 14, the mentioned desired compensation of crosstalk can be achieved even when the distance between the layers is selected smaller than $\sqrt{3}\cdot a$, since, in this situation, it is still possible to achieve compensation of crosstalk between $A_+$ and $D_+$ and between $A_-$ and $D_+$ as well as the desired reduction of crosstalk between $A_-$, $B_+$.

Figure 8A:
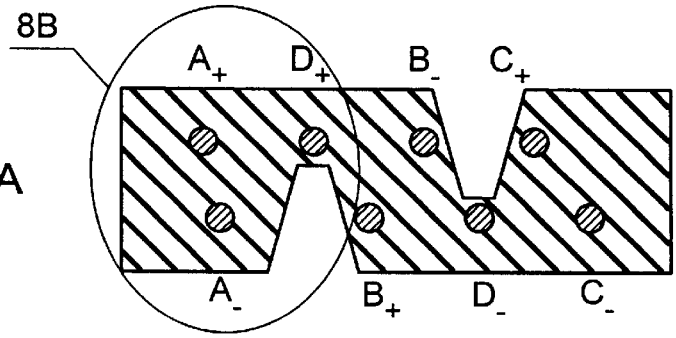
FIGS. 8*a* and 8*b* show a further embodiment of a connector according to the invention.
Figure 8B:
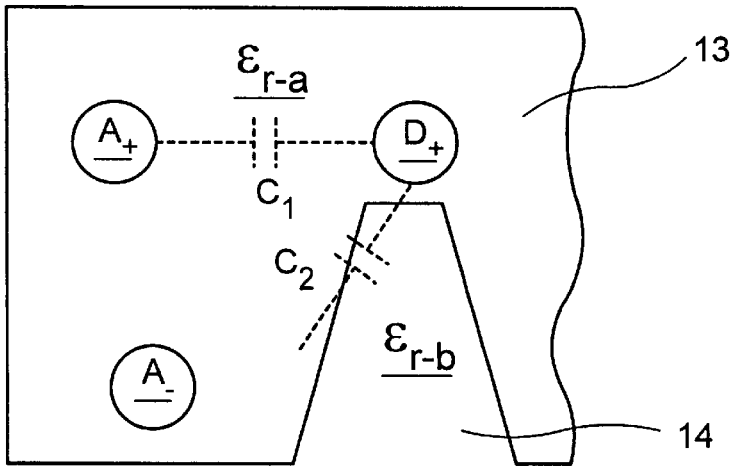

FIG. 8 shows a further embodiment of a connector according to the invention. The figure illustrates that it is possible to achieve a further reduction of the crosstalk between individual conductors by placing these at a greater mutual distance. Since, as mentioned, it is expedient to achieve a reduction of the capacitive coupling between $A_-$, $B_+$ and $B_-$, $C_+$, the figure shows an example where the distance between $A_-$, $B_+$ and $B_-$, $C_+$, respectively, has been made greater than in the embodiment shown in FIGS. 6 and 7. A suitable selection of the permittivity may ensure that the desired compensation between the conductors is still achieved, as mentioned above.

Although the invention has been explained in connection with specific embodiments of the connecting conductors, nothing prevents the method from being used in other configurations, for the mere reason that the notch may be made with many geometrical shapes.

What is claimed is:

1. A method of reducing signal cross talk during coupling in a connector for the transfer of balanced electrical high frequency signals, the method comprising providing a connector comprising contact springs (5) and terminals (4) as well as first and second non-co-axial pairs of first and second conductors ($A_+$, $A_-$), ($D_+$, $D_-$) arranged in an insulation member (9) to connect the contact springs (5) and the terminals (4) for respectively transferring the balanced signals, wherein the conductors ($A_+$, $A_-$), ($D_+$, $D_-$) of each of the pairs are respectively in two spaced layer, and an effective permittivity $\in_{r-1}$ between the first conductor ($A_+$) of the first pair of conductors ($A_+$, $A_-$) and the first conductor ($D_+$) of the second pair of conductors ($D_+$, $D_-$) is different from an effective permittivity $\in_{r-2}$ between the second conductor ($A_-$) of the first pair of conductors ($A_+$, $A_-$) and first conductor ($D_+$) of the second pair of conductor ($D_+$, $D_-$), wherein one of the effective permittivities comprises a notch in the insulation member all along the conductors.

2. A method according to claim 1 wherein one of the effective permittivities comprises atmospheric air in the notch.

3. A method according to claim 1, wherein the notch is filled with a dielectric (14) consisting of a solid material with a permittivity lower than the permittivity of the insulation member.

4. A method according to claim 1 wherein the first and second conductors ($A_+$, $A_-$) of the first pair of conductors ($A_+$, $A_-$) are substantially equidistant from the first conductor ($D_+$) of the second pair of conductors ($D_+$, $D_-$).

5. A connector for the transfer of balanced electrical high frequency signals, said connector comprising contact springs and terminals as well as a plurality of non-co-axial pairs of conductors ($A_+$, $A_-$), ($D_+$, $D_-$) arranged in an insulation member to connect the contact springs (5) and the terminals (4), each said pair of conductors being capable of transferring one of the balanced signals, wherein the pairs of conductors ($A_+$, $A_-$), ($D_+$, $D_-$) in the insulation member (9) are arranged in two mutually spaced layers in such a manner that each of the two conductors (6) belonging to a pair is arranged in a layer of its own, and that the insulation member (9) comprises at least two dielectrics with different permittivity $\in_{r-a}$, $\in_{r-b}$, and that the effective permittivity $\in_{r-1}$ of the dielectric material between a first conductor ($A_+$) of a first pair of conductors ($A_+$, $A_-$) and a first conductor ($D_+$) of a second pair of conductors ($D_+$, $D_-$) is different from the effective permittivity $\in_{r-2}$ of the dielectric material between the second conductor ($A_-$) of the first pair of conductors ($A_+$, $A_-$) and the first conductor ($D_+$, $D_-$) of the second pair of conductors ($D_+$, $D_-$), wherein one of the dielectric material has a notch all along the conductors.

6. A connector according to claim 5, wherein one of the dielectric materials comprises atmospheric air in the notch.

7. A connector according to claim 6, wherein the notch is V-shape.

8. A connector according to claim 5, wherein the notch is filled with a dielectric consisting of a solid material with a permittivity different from a permittivity of the notched dielectric material.

9. A connector according to claim 5, wherein the two layers in which the conductors (6) are arranged are parallel planes, and the conductors (6) are parallel.

10. A connector according to claim 9, wherein the conductors (6) in the two layers are respectively spaced at the same or approximately the same mutual distance.

11. A cable terminated by a connector according to claim 5 at one or both ends.

12. A connector according to claim 5 wherein the first and second conductors ($A_+$, $A_-$) of the first pair of conductors ($A_+$, $A_-$) are substantially equidistant from the first conductor ($D_+$) of the second pair of conductors ($D_+$, $D_-$).

13. A connector element comprising a plurality of non-co-axial pair of conductors ($A_+$, $A_-$), ($D_+$, $D_-$) arranged in an insulation member for the transfer of balance electrical high frequency signals, each said pair of conductors being capable of transferring one of the balance signals, wherein the pairs of conductors ($A_+$, $A_-$), ($D_+$, $D_-$) in the insulation member (9) are arranged in two mutually spaced layers in such a manner that each of the two conductors (6) belonging to a pair is arranged in a layer of its own, and that said insulation member (9) comprises at least two dielectrics with different permittivity $\in_{r-a}$, $\in_{r-b}$, and that the effective permittivity $\in_{r-1}$ of the dielectric material between a first conductor ($A_+$) of a first pair of conductors ($A_+$, $A_-$) and a first conductor ($D_+$) of a second pair of conductors ($D_-$, $D_-$) is different from the effective permittivity $\in_{r-2}$ of the dielectric material between the second conductor ($A_-$) of the first pair of conductor ($A_+$, $A_-$) and the first conductor ($D_+$) of the second pair of conductors ($D_+$, $D_-$), wherein one of the dielectrics comprises a notch all along the conductors.

14. A connecting element according to claim 13 wherein the first and second conductors ($A_+$, $A_-$) of the first pair of conductors ($A_+$, $A_-$) are substantially equidistant from the first conductor ($D_+$) of the second pair of conductors ($D_+$, $D_-$).

* * * * *